US012631165B2

(12) United States Patent
Nishida et al.

(10) Patent No.: US 12,631,165 B2
(45) Date of Patent: May 19, 2026

(54) ROTARY SWASH PLATE HYDRAULIC PUMP

(71) Applicant: KAWASAKI JUKOGYO KABUSHIKI KAISHA, Kobe (JP)

(72) Inventors: Shinji Nishida, Kobe (JP); Isamu Yoshimura, Kobe (JP); Satoru Takao, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 18/852,385

(22) PCT Filed: Mar. 22, 2023

(86) PCT No.: PCT/JP2023/011233
§ 371 (c)(1),
(2) Date: Sep. 27, 2024

(87) PCT Pub. No.: WO2023/189943
PCT Pub. Date: Oct. 5, 2023

(65) Prior Publication Data

US 2025/0207570 A1 Jun. 26, 2025

(30) Foreign Application Priority Data

Mar. 31, 2022 (JP) ..... 2022-061102

(51) Int. Cl.
*F04B 1/182* (2020.01)
*F04B 1/28* (2006.01)

(52) U.S. Cl.
CPC ..... *F04B 1/28* (2013.01); *F04B 1/182* (2013.01)

(58) Field of Classification Search
CPC . F04B 1/14–188; F04B 1/26–295; F04B 1/34
See application file for complete search history.

(56) References Cited

U.S. PATENT DOCUMENTS 2,867,976 A * 1/1959 Huber ..... F04B 49/24 60/443
2,945,444 A * 7/1960 Leissner ..... F04B 49/18 417/454

(Continued)

FOREIGN PATENT DOCUMENTS

CA 2303035 A1 3/1999
JP S45021857 B1 7/1970

(Continued)

OTHER PUBLICATIONS

ISA Japan Patent Office, Written Opinion Issued in Application No. PCT/JP2023/011233, May 23, 2023, WIPO, 6 pages.

(Continued)

*Primary Examiner* — Thomas Fink
(74) *Attorney, Agent, or Firm* — Alleman Hall LLP

(57) ABSTRACT

This rotary swash plate hydraulic pump includes: a casing; a cylinder block including a cylinder bore and disposed in the casing so as to prevent relative rotation of the cylinder block; a piston that is inserted into the cylinder bore; a rotary swash plate that is housed in the casing so as to be rotatable about an axis and reciprocates the piston; and a variable capacity mechanism that changes an effective stroke length of the piston. The variable capacity mechanism includes a spool that changes the effective stroke length of the piston by adjusting opening and closing of the cylinder bore that corresponds to the spool. The cylinder block includes a spool hole into which the spool is inserted.

9 Claims, 4 Drawing Sheets

(56) References Cited

U.S. PATENT DOCUMENTS

| | | | | | |
|---|---|---|---|---|---|
| 3,002,462 | A * | 10/1961 | Raymond | ..... | F04B 49/08<br>417/213 |
| 3,873,240 | A * | 3/1975 | Leduc | ..... | F04B 1/295<br>417/270 |
| 2022/0349398 | A1 * | 11/2022 | Andras | ..... | F04B 49/06 |

FOREIGN PATENT DOCUMENTS

| | | | | | |
|---|---|---|---|---|---|
| JP | H1182671 | A * | 3/1999 | ..... | F04B 1/2042 |
| JP | 2016205266 | A | 12/2016 | | |

OTHER PUBLICATIONS

ISA Japan Patent Office, International Search Report Issued in Application No. PCT/JP2023/011233, May 23, 2023, WIPO, 5 pages.

* cited by examiner

ROTARY SWASH PLATE HYDRAULIC PUMP

TECHNICAL FIELD

The present invention relates to a rotary swash plate hydraulic pump in which a rotary swash plate is rotated to reciprocate a piston.

BACKGROUND ART

For example, a rotary swash plate piston pump such as that disclosed in Patent Literature (PTL) 1 is known as a piston pump. In the piston pump disclosed in PTL 1, a piston reciprocates when a rotary swash plate rotates. As a result, pressure oil is discharged from the piston pump.

CITATION LIST

Patent Literature

PTL 1: Japanese Laid-Open Patent Application Publication No. 2016-205266

SUMMARY OF INVENTION

Technical Problem

The piston pump disclosed in PTL 1 has a fixed discharge capacity. It is desired that piston pumps have a discharge capacity that can be changed according to circumstances. Furthermore, it is desired that rotary swash plate piston pumps with a variable discharge capacity be compact in size.

Thus, an object of the present invention is to provide a rotary swash plate hydraulic pump with a variable discharge capacity that can be made compact.

Solution to Problem

A rotary swash plate hydraulic pump according to the present invention includes: a casing; a cylinder block including a cylinder bore and disposed in the casing so as to prevent relative rotation of the cylinder block; a piston that is inserted into the cylinder bore; a rotary swash plate that is housed in the casing so as to be rotatable about an axis and reciprocates the piston; and a variable capacity mechanism that changes an effective stroke length of the piston. The variable capacity mechanism includes a spool that changes the effective stroke length of the piston by adjusting opening and closing of the cylinder bore that corresponds to the spool. The cylinder block includes a spool hole into which the spool is inserted.

According to the present invention, the variable capacity mechanism includes a spool that changes the effective stroke length of the piston. Therefore, the discharge capacity of the rotary swash plate hydraulic pump can be changed. The cylinder block includes a spool hole into which the spool is inserted. Therefore, as compared to the case where the spool hole is positioned in the casing outside the cylinder block, the spool hole can be compactly placed, meaning that the rotary swash plate hydraulic pump can be made compact. Thus, the rotary swash plate hydraulic pump with a variable discharge capacity can be made compact.

A rotary swash plate hydraulic pump according to the present invention includes: a casing; a cylinder block including a cylinder bore and disposed in the casing so as to prevent relative rotation of the cylinder block; a piston that is inserted into the cylinder bore; a rotary swash plate that is housed in the casing so as to be rotatable about an axis and reciprocates the piston; a variable capacity mechanism that changes an effective stroke length of the piston; an inlet check valve that allows a flow of a working fluid in one direction to the cylinder bore and blocks an opposite flow of the working fluid; and a discharge check valve that allows a flow of the working fluid in one direction discharged from the cylinder bore and blocks an opposite flow of the working fluid. The piston is inserted into an end of the cylinder bore that is located on one side in an axial direction. The cylinder bore is connected to an inlet passage on the other side in the axial direction. The inlet check valve is inserted into a portion of the cylinder bore that is located on the other side in the axial direction. The discharge check valve is positioned radially outward of the inlet check valve as viewed in the axial direction.

According to the present invention, the inlet check valve is inserted into the other axial end portion of the cylinder bore. As a result, the inlet check valve connects the cylinder bore and the inlet passage, and thus a cylinder port can be eliminated. The discharge check valve is positioned radially outward of the inlet check valve as viewed in the axial direction, and the discharge check valve extends radially outward. Therefore, the rotary swash plate hydraulic pump can be made more compact.

Advantageous Effects of Invention

According to the present invention, a rotary swash plate hydraulic pump can be made compact with a variable discharge capacity.

The above object, other objects, features, and advantages of the present invention will be made clear by the following detailed explanation of preferred embodiments with reference to the attached drawings.

DESCRIPTION OF EMBODIMENTS

Figure 1:
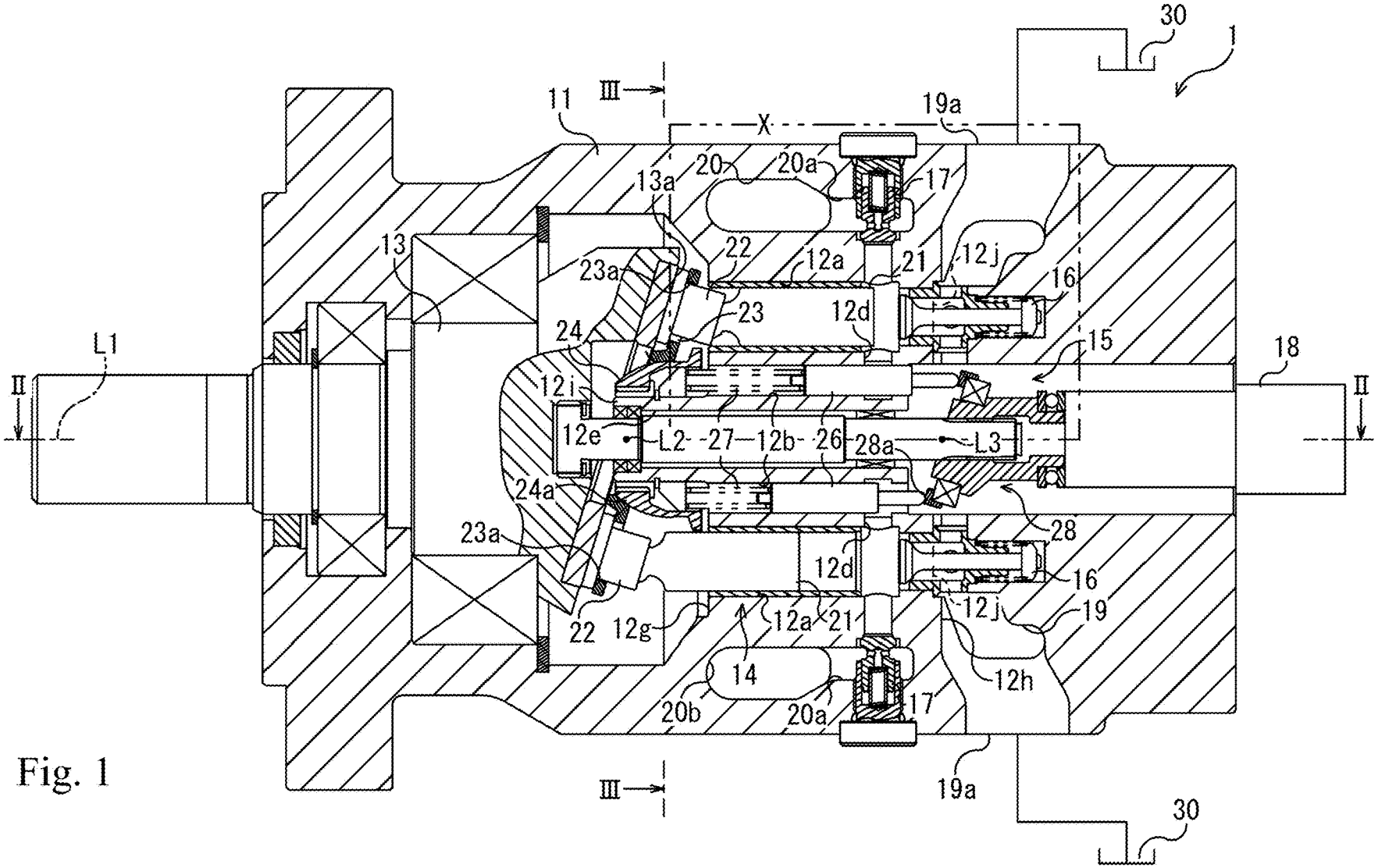
FIG. 1 is a cross-sectional view of a rotary swash plate hydraulic pump according to an embodiment of the present invention.

Hereinafter, a rotary swash plate hydraulic pump 1 according to an embodiment of the present invention will be described with reference to the aforementioned drawings. Note that the concept of directions mentioned in the following description is used for the sake of explanation; the orientations, etc., of elements according to the invention are not limited to these directions. The rotary swash plate hydraulic pump 1 described below is merely one embodiment of the present invention. Thus, the present invention is not limited to the embodiments and may be subject to addition, deletion, and alteration within the scope of the essence of the invention.

<Rotary Swash Plate Hydraulic Pump>

The rotary swash plate hydraulic pump 1 illustrated in FIG. 1 and FIG. 2 (hereinafter referred to as "the pump 1") is provided in various machines, for example, construction equipment such as an excavator and a crane, industrial equipment such as a forklift, farm equipment such as a tractor, and hydraulic equipment such as a press machine. In the present embodiment, the pump 1 is a hydraulic pump of the rotary swash plate type with a variable capacity. The pump 1 includes a casing 11, a cylinder block 12, a rotary swash plate 13, a plurality of pistons 21, and a variable capacity mechanism 15. Furthermore, the pump 1 includes a plurality of inlet check valves 16, a plurality of discharge check valves 17, a plurality of shoes 22, a pressing plate 23, a spherical bushing 24, and a plurality of biasing members 25. Note that the plurality of pistons 21 constitute a piston mechanism 14 together with the plurality of shoes 22, the pressing plate 23, the spherical bushing 24, and the plurality of biasing members 25. The pump 1 is driven by a drive source (for example, one or both of an engine and an electric motor). Thus, the pump 1 discharges the working fluid.

<Casing>

The casing 11 houses the cylinder block 12, the rotary swash plate 13, the piston mechanism 14, and the variable capacity mechanism 15. The casing 11 includes an inlet passage 19 and a discharge passage 20. The casing 11, which is a cylindrical member, extends along a predetermined axis L1. The casing 11 is open at one end and the other end that are on one side and the other side in an axial direction in which the axis L1 extends.

The inlet passage 19 is formed in the other end portion of the casing 11. More specifically, the inlet passage 19 is disposed on the other side of the cylinder block 12 in the axial direction. The inlet passage 19 is connected to a plurality of cylinder bores 12*a* of the cylinder block 12, which will be described in detail later. Furthermore, the inlet passage 19 is connected to a tank 30 via an inlet port 19*a*. The inlet passage 19 draws in the working fluid from the tank 30 through the inlet port 19*a*. The working fluid drawn from the tank 30 flows in the inlet passage 19.

The discharge passage 20 includes a plurality of branch portions 20*a* and a ring-shaped portion 20*b*. The discharge passage 20 is formed in a middle portion of the casing 11. The discharge passage 20 is connected to each of the cylinder bores 12*a* of the cylinder block 12, which will be described in detail later. Each of the branch portions 20*a* is connected to a corresponding one of the cylinder bores 12*a*. More specifically, each of the branch portions 20*a* is connected to a side surface of a corresponding one of the cylinder bores 12*a*. Each of the branch portions 20*a* rises radially outward from the corresponding cylinder bore 12*a*, is then bent, and extends in one axial direction. The ring-shaped portion 20*b* is positioned so as to exteriorly surround the cylinder block 12, more specifically, the cylinder bores 12*a* of the cylinder block 12. The ring-shaped portion 20*b* is connected to the branch portions 20*a*. Therefore, the working fluid is brought from the cylinder bores 12*a* to the ring-shaped portion 20*b* via the branch portions 20*a*. The ring-shaped portion 20*b* is connected to a hydraulic actuator, for example, via a discharge port 20*c*. The working fluid brought to the ring-shaped portion 20*b* is discharged to the hydraulic actuator via the discharge port 20*c*.

<Cylinder Block>

Figure 2:
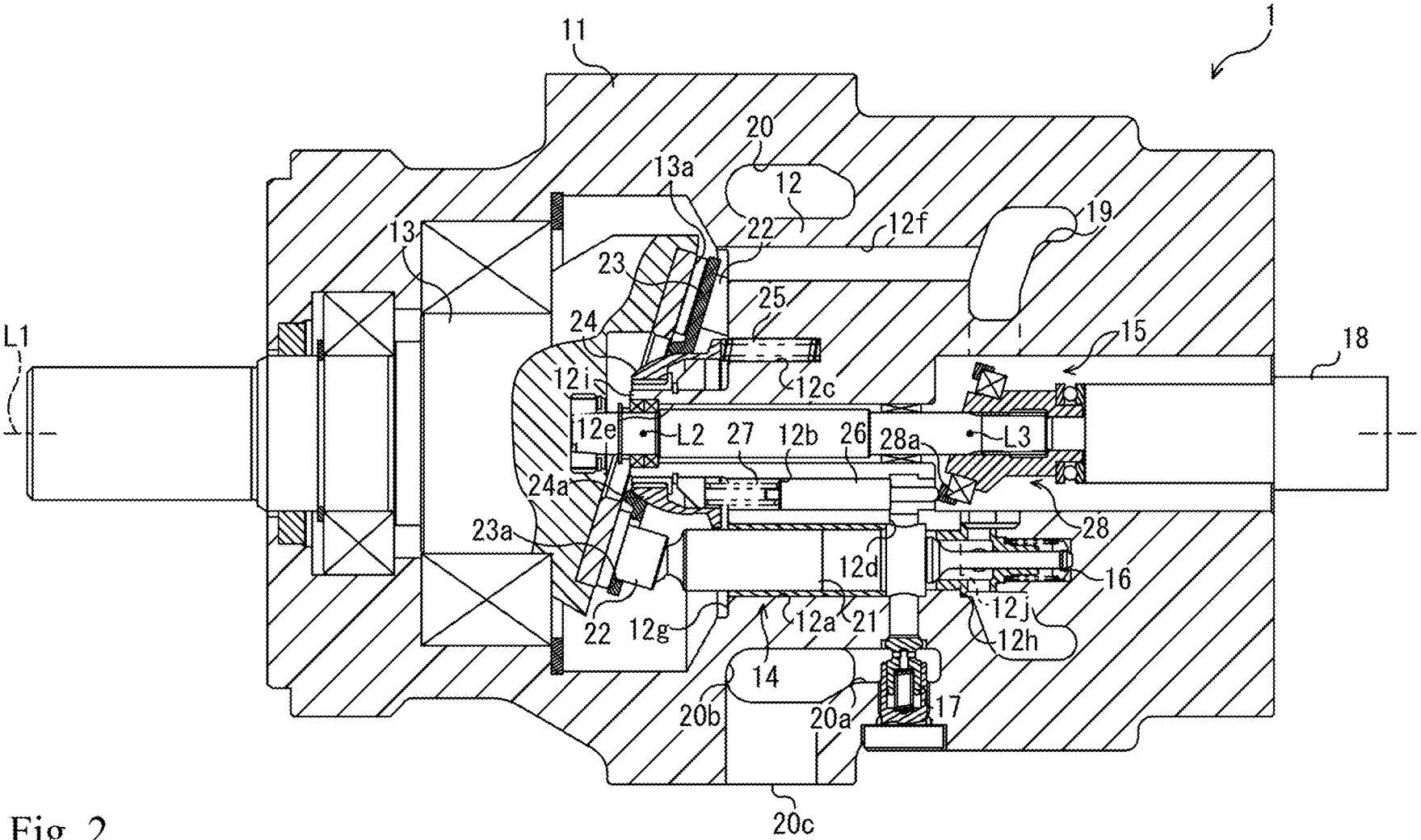
FIG. 2 is a cross-sectional view of the rotary swash plate hydraulic pump taken along the section line II-II indicated in FIG. 1.
Figure 3:
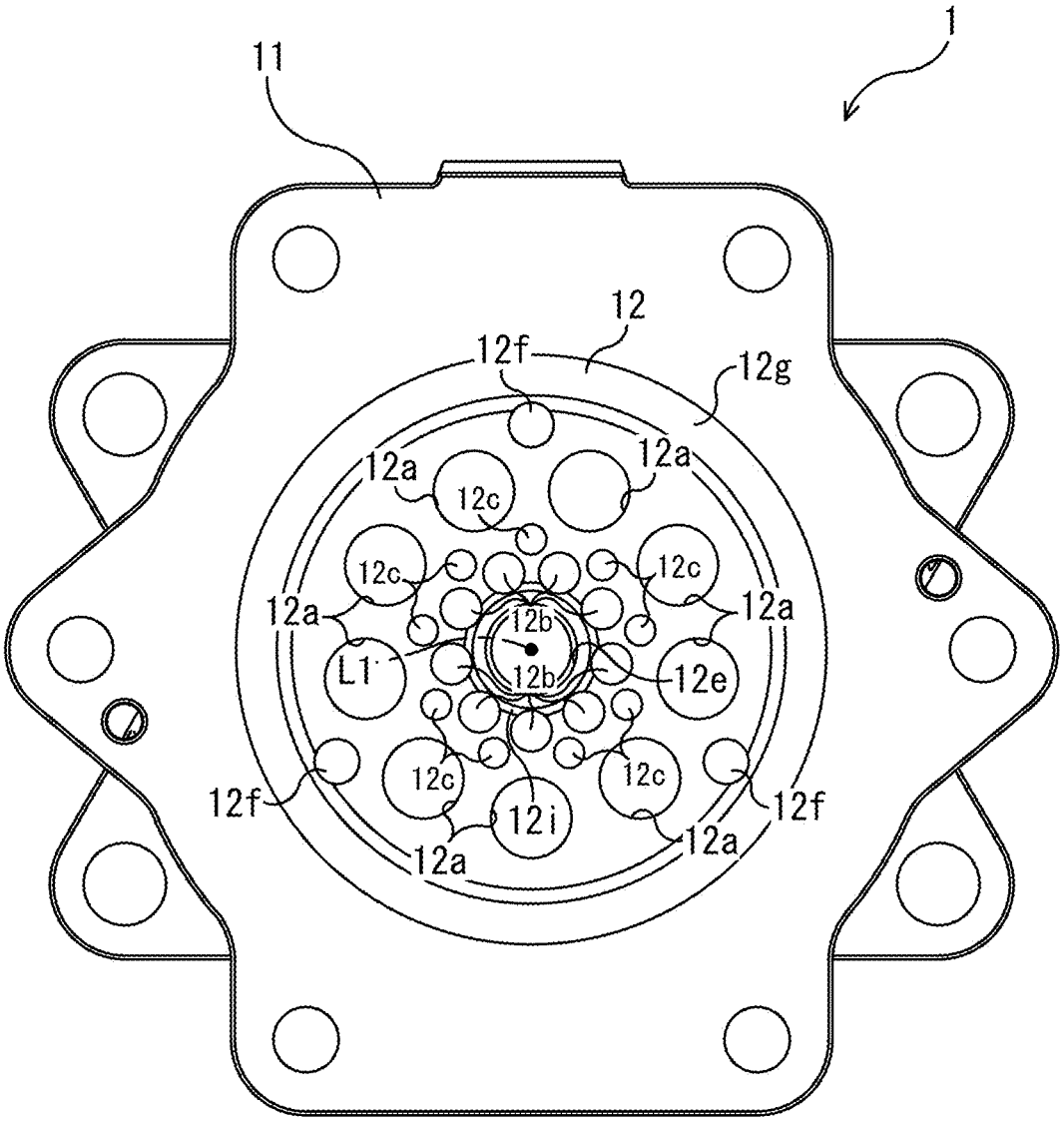
FIG. 3 is a cross-sectional view of a casing taken along the section line III-III indicated in FIG. 1.

The cylinder block 12 includes the plurality of cylinder bores 12*a* and a plurality of spool holes 12*b*, as illustrated in FIG. 3. Furthermore, the cylinder block 12 includes a plurality of housing holes 12*c*, a plurality of communication passages 12*d*, a shaft insertion hole 12*e*, and a plurality of communication holes 12*f*. The cylinder block 12 is disposed inside the casing 11 so as to prevent relative rotation thereof. More specifically, the cylinder block 12 is fixed to the casing 11. In the present embodiment, the cylinder block 12 is integrally formed on an axially middle portion of the casing 11. However, the cylinder block 12 may be separate from the casing 11. Note that in the case of being separate, the cylinder block 12 is fixed to the casing 11 by press fitting, spline connection, key connection, fastening, or joining, for example. On one end surface 12*g* of the cylinder block 12, a projection 12*i* is formed about the axis L1 (refer also to FIG. 1 and FIG. 2). The other end surface 12*h* of the cylinder block 12 faces the inlet passage 19. The other end surface 12*h* is an end surface of the cylinder block 12 that is located on the other side in the axial direction.

<Cylinder Bore>

Each of the cylinder bores 12*a* is open on the one end surface 12*g* of the cylinder block 12. The one end surface 12*g* is an end surface of the cylinder block 12 that is located on one side in the axial direction. In the present embodiment, nine cylinder bores 12*a* are open on the one end surface 12*g* of the cylinder block 12. Note that the number of cylinder bores 12*a* is not limited to nine.

The cylinder bores 12*a* are arranged circumferentially spaced apart (in the present embodiment, at equal distances) about the axis L1. The cylinder bores 12*a* extend from the one end surface 12*g* to the other end surface 12*h* in the other axial direction. Note that the other end surface 12*h* is an end surface of the cylinder block 12 that is located on the other side in the axial direction. The cylinder bores 12*a* are connected to the inlet passage 19 on the other side in the axial direction. More specifically, the cylinder bores 12*a* include inlet-end openings 12*j* that are open on the other end surface 12*h* of the cylinder block 12, as illustrated in FIG. 1 and FIG. 2. The cylinder bores 12*a* are connected to the inlet passage 19 via the inlet-end openings 12*j*.

<Spool Hole>

Each of the spool holes 12*b* is formed in the cylinder block 12. More specifically, the same number of spool holes 12*b* as the cylinder bores 12*a* (in the present embodiment, nine spool holes 12*b*) are formed in the cylinder block 12. Each of the spool holes 12*b* is connected to the tank 30. More specifically, the spool holes 12*b* are connected to the tank 30 via the inlet passage 19. The spool holes 12*b* are also arranged circumferentially spaced apart (in the present embodiment, at equal distances) about the axis L1. More specifically, the spool holes 12*b* extend in the cylinder block 12 from the other end surface 12*h* to the one end surface 12*g*. The spool holes 12*b* are open on the one end surface 12*g*, as illustrated in FIG. 3. The spool holes 12*b* are arranged at equal distances about the projection 12*i*. The spool holes 12*b* are positioned inward (in the present embodiment, radially inward) of the cylinder bores 12*a*. Each of the spool holes 12*b* herein is associated with a corresponding one of the cylinder bores 12*a*. Each of the spool holes 12*b* is positioned radially inward of the corresponding cylinder bore 12*a*. In other words, the spool hole 12*b* and the cylinder bore 12*a* that correspond to each other are arranged radially in series with each other. The spool hole 12*b* is for releasing part of the capacity of the cylinder bore 12*a*. For example, the diameter of the spool hole 12*b* is smaller than the diameter of the cylinder bore 12*a*.

<Housing Hole>

Each of the biasing members 25, which will be described in detail later, is housed in a corresponding one of the housing holes 12*c*. Each of the housing holes 12*c* is open on the one end surface 12*g* of the cylinder block 12. In the present embodiment, nine housing holes 12*c* are open on the one end surface 12*g* of the cylinder block 12. Note that the number of housing holes 12*c* is not limited to nine. The housing holes 12*c* are also arranged circumferentially spaced apart (in the present embodiment, at equal distances) about the axis L1. More specifically, the housing holes 12*c* are arranged at equal distances around the spool holes 12*b*. The housing holes 12*c* are disposed between the spool holes 12*b* and the cylinder bores 12*a* in the radial direction. More specifically, the central axis of each of the housing holes 12*c* is located between the spool holes 12*b* and the cylinder bores 12*a*. Mor specifically, the housing holes 12*c* are arranged in a staggered pattern with respect to the cylinder bores 12*a* and the spool holes 12*b*. This reduces increases in the outer diameter dimensions of the cylinder blocks 12 and the casing 11.

<Communication Passage>

Each of the communication passages 12*d* connects one of the cylinder bores 12*a* and a corresponding one of the spool holes 12*b*, as illustrated in FIG. 1 and FIG. 2. This means that the same number of communication passages 12*d* as the cylinder bores 12*a* and the spool holes 12*b* (in the present embodiment, nine communication passages 12*d*) are formed in the cylinder block 12. The communication passages 12*d* extend in the radial direction. The communication passages 12*d* are located on the side of the other end surface 12*h* in the cylinder block 12.

<Shaft Insertion Hole>

The shaft insertion hole 12*e* is formed along the axis L1 in the cylinder block 12. The shaft insertion hole 12*e* penetrates the cylinder block 12 from the leading end surface of the projection 12*i* to the other end surface 12*h* in the axial direction.

<Communication Hole>

Each of the communication holes 12*f* penetrates the cylinder block 12 from the one end surface 12*g* to the other end surface 12*h*. In the present embodiment, three communication holes 12*f* are formed in the cylinder block 12, as illustrated in FIG. 3. Note that the number of communication holes 12*f* is not limited to three. Each of the communication holes 12*f* is positioned radially outward of the cylinder bores 12*a*. The communication holes 12*f* are arranged circumferentially spaced apart (in the present embodiment, at equal distances). The communication holes 12*f* are connected to the inlet passage 19 and brings the working fluid in the inlet passage 19 to a rotary swash plate-end inclined surface 13*a* of the rotary swash plate 13, which will be described later. Thus, the rotary swash plate-end inclined surface 13*a* is cooled.

<Rotary Swash Plate>

The rotary swash plate 13 includes the rotary swash plate-end inclined surface 13*a*, as illustrated in FIG. 1 and FIG. 2. The rotary swash plate 13 is housed in the casing 11 so as to be rotatable about the axis L1. More specifically, the rotary swash plate 13 is housed on one side in the axial direction in the casing 11. The rotary swash plate 13 extends along the axis L1. The rotary swash plate 13 is supported on the casing 11 so as to be rotatable about the axis L1. The rotary swash plate 13 is disposed so as to face the one end surface 12*g* of the cylinder block 12. One end portion of the rotary swash plate 13 protrudes from one end of the casing 11. In an area located on one side in the axial direction, the one end portion of the rotary swash plate 13 is coupled to the drive source mentioned above. The rotary swash plate 13 is rotatably driven by the drive source. The rotary swash plate 13 rotates to reciprocate the pistons 21, which will be described in detail later. In the present embodiment, the rotary swash plate 13 integrally includes: a disc-shaped portion including the rotary swash plate-end inclined surface 13*a*; and a shaft portion that is rotatably supported, but the disc-shaped portion and the shaft portion may be separately formed.

The rotary swash plate-end inclined surface 13*a* is formed on the other end of the rotary swash plate 13. The rotary swash plate-end inclined surface 13*a* faces the one end surface 12*g* of the cylinder block 12. The rotary swash plate-end inclined surface 13*a* is tilted toward the one end surface 12*g* of the cylinder block 12 about a first perpendicular axis L2. The first perpendicular axis L2 is an axis perpendicular to the axis L1. In the present embodiment, the tilt angle of the rotary swash plate-end inclined surface 13*a* is fixed. Note that for the sake of explanation, the slope of the rotary swash plate-end inclined surface 13*a* illustrated in FIG. 2 is different from the slope of the rotary swash plate-end inclined surface 13*a* illustrated in FIG. 1.

<Piston Mechanism>

The piston mechanism 14 includes the plurality of pistons 21, the plurality of shoes 22, the pressing plate 23, the spherical bushing 24, and the plurality of biasing members 25, as illustrated in FIG. 2. Each of the pistons 21 is inserted into an end of a corresponding one of the cylinder bores 12*a* of the cylinder block 12 that is located on one side in the axial direction. In other words, the same number of pistons 21 as the cylinder bores 12*a* (in the present embodiment, nine pistons 21) are inserted into the cylinder block 12. When the rotary swash plate 13 rotates, each of the pistons 21 reciprocates within the corresponding cylinder bore 12*a*.

Each of the shoes 22 is rotatably coupled to a corresponding one of the pistons 21. More specifically, the shoe 22 is rotatably coupled to the leading end portion of the piston 21. In the present embodiment, the piston mechanism 14 includes the same number of shoes 22 as the pistons 21, specifically, nine shoes 22. Each of the shoes 22 abuts the rotary swash plate 13. The shoes 22 are arranged at equal distances about the axis L1 as with the pistons 21 and are in abutment with the rotary swash plate-end inclined surface 13*a* of the rotary swash plate 13. The rotary swash plate-end inclined surface 13*a* slides on the shoes 22.

The pressing plate 23 is attached to the shoes 22. More specifically, the pressing plate 23 is a plate-shaped member in the shape of a circular ring. The pressing plate 23 includes a shoe insertion hole 23*a*. In the present embodiment, the pressing plate 23 includes the same number of shoe insertion holes 23*a* as the shoes 22 (specifically, nine shoe insertion holes 23*a*). Each of the shoes 22 is inserted through a corresponding one of the shoe insertion holes 23*a*.

The spherical bushing 24 supports the pressing plate 23 in a rollable form. More specifically, the spherical bushing 24 is provided on the exterior of the projection 12*i*. A partial spherical portion 24*a* that is a leading end portion, specifically, one axial end portion, of the spherical bushing 24, is formed in the shape of a partial sphere. The pressing plate 23 is provided on the exterior of the partial spherical portion 24*a* of the spherical bushing 24 in a rollable form. Thus, the pressing plate 23 rolls on the partial spherical portion 24*a* of the spherical bushing 24 according to the movement of the rotary swash plate-end inclined surface 13*a*.

The biasing members 25 are housed in the housing holes 12*c*. The biasing members 25 bias the pressing plate 23 toward the rotary swash plate 13. Thus, the biasing members 25 press the shoes 22 against the rotary swash plate 13 via the pressing plate 23. More specifically, the biasing members 25 bias the pressing plate 23 toward the rotary swash plate 13 via the spherical bushing 24. As a result, the shoes 22 are pressed against the rotary swash plate 13. In the present embodiment, the piston mechanism 14 includes the same number of biasing members 25 as the housing holes 12*c*, specifically, nine biasing members 25. Note that the number of biasing members 25 included in the piston mechanism 14 is not limited to nine. Each of the biasing members 25 herein is a helical compression spring. The biasing members 25 are compressed on the housing holes 12*c* when inserted through the housing holes 12*c*.

<Variable Capacity Mechanism>

The variable capacity mechanism 15 includes a plurality of spools 26, a plurality of springs 27, and a swash plate rotating shaft 28, as illustrated in FIG. 1. In the present embodiment, the variable capacity mechanism 15 includes the same number of spools 26 and springs 27 as the spool holes 12*b*, specifically, nine spools 26 and nine springs 27. The variable capacity mechanism 15 adjusts an effective stroke length S of each of the nine pistons 21. In the present embodiment, the variable capacity mechanism 15 changes the effective stroke lengths S of the pistons 21 by opening and closing the cylinder bores 12*a*. By changing the effective stroke lengths S, the discharge capacity of the pump 1 changes.

More specifically, the variable capacity mechanism 15 adjusts the opening and closing of the path between the cylinder bore 12*a* and the tank 30 during the travel of the piston 21 from the bottom dead center to the top dead center (in other words, in the discharge process of the pump 1). In the present embodiment, the variable capacity mechanism 15 adjusts the opening and closing of the communication passages 12*d*. Thus, the variable capacity mechanism 15 adjusts the effective stroke length S of each of the pistons 21. However, the variable capacity mechanism 15 is not limited to a mechanism that adjusts the effective stroke lengths S of all the nine pistons 21. Note that the top dead center is the position of the piston 21 that is at the far end on the other side in the axial direction, and the bottom dead center is the position of the piston 21 that is at the far end on one side in the axial direction.

<Spool>

The spools 26 are arranged corresponding to the cylinder bores 12*a*, respectively. More specifically, each of the spools 26 is inserted into a corresponding one of the spool holes 12*b* of the cylinder block 12 in such a manner that the spool 26 can reciprocate therein. The spool 26 opens and closes the corresponding cylinder bore 12*a*. More specifically, the spool 26 reciprocates to open and close the path between the corresponding cylinder bore 12*a* and the tank 30. In the present embodiment, by opening and closing the path, the spool 26 connects the corresponding cylinder bore 12*a* and the inlet passage 19. Thus, the cylinder bores 12*a* are connected to the tank 30 via the inlet passage 19. The spools 26 adjust the effective stroke lengths S of the pistons 21 by adjusting the opening and closing of the paths between the cylinder bores 12*a* and the tank 30 in the discharge process.

<Spring>

Each of the springs 27 is compressed when inserted into a corresponding one of the spool holes 12*b*. More specifically, the spring 27 is disposed on one side of the spool 26 in the axial direction in the spool hole 12*b*. The springs 27 bias the spools 26 toward the swash plate rotating shaft 28 to be described later.

<Swash Plate Rotating Shaft>

The swash plate rotating shaft 28 rotates in conjunction with the rotary swash plate 13. The swash plate rotating shaft 28 rotates to reciprocate each of the spools 26. Thus, the swash plate rotating shaft 28 causes the spools 26 to open and close the paths between the cylinder bores 12*a* and the tank 30. Here, the swash plate rotating shaft 28 causes the spools 26 to open and close the communication passages 12*d*. Furthermore, the swash plate rotating shaft 28 can change the opening/closing position of each of the spools 26. The opening/closing position of each of the spools 26 is a position at which the spool 26 starts opening the communication passage 12*d* and a position at which the spool 26 starts closing the communication passage 12*d*.

More specifically, the swash plate rotating shaft 28 includes a swash plate rotating shaft-end inclined surface 28*a*. The swash plate rotating shaft 28 is inserted through the shaft insertion hole 12*e* of the cylinder block 12 and extends along the axis L1. One axial end portion of the swash plate rotating shaft 28 protrudes from the shaft insertion hole 12*e* toward the rotary swash plate 13. The one axial end portion of the swash plate rotating shaft 28 is coupled to the rotary swash plate 13 so as to prevent relative rotation thereof. Therefore, the swash plate rotating shaft 28 rotates about the axis L1 in conjunction with the rotary swash plate 13. The other axial end portion of the swash plate rotating shaft 28 also protrudes from the shaft insertion hole 12*e* toward the inlet passage 19.

The swash plate rotating shaft-end inclined surface 28*a* is located on an axially middle portion of the swash plate rotating shaft 28. The swash plate rotating shaft-end inclined surface 28*a* faces the other end surface 12*h* of the cylinder block 12. More specifically, the swash plate rotating shaft-end inclined surface 28*a* faces the openings of the spool holes 12*b* that are located on the other side in the axial direction. The swash plate rotating shaft-end inclined surface 28*a* is tilted about a second perpendicular axis L3 parallel to the first perpendicular axis L2. The second perpendicular axis L3 is also an axis perpendicular to the axis L1. In the present embodiment, the swash plate rotating shaft-end inclined surface 28*a* is tilted in the same direction as the rotary swash plate-end inclined surface 13*a*, and the tilt angle of the swash plate rotating shaft-end inclined surface 28*a* is fixed. The other axial ends of the spools 26 that are biased by the springs 27 are in abutment with the swash plate rotating shaft-end inclined surface 28*a*. The swash plate rotating shaft-end inclined surface 28*a* slidably rotates on the spools 26. Therefore, when the swash plate rotating shaft 28 rotates, the spools 26 reciprocate within the spool holes 12*b* with a stroke length corresponding to the tilt angle of the swash plate rotating shaft-end inclined surface 28*a*.

The swash plate rotating shaft-end inclined surface 28*a* can move back and forth in the axial direction. By moving back and forth, the swash plate rotating shaft-end inclined surface 28*a* adjusts the opening and closing of the path between the cylinder bore 12*a* and the tank 30. More specifically, the swash plate rotating shaft-end inclined surface 28*a* moves back and forth to adjust the opening/closing position of the spool 26. The linear motion actuator 18 is connected to the other axial end portion of the swash plate rotating shaft 28. Note that the linear motion actuator 18 may either be an electric linear motion actuator or a hydraulic linear motion actuator. The linear motion actuator 18 allows the swash plate rotating shaft-end inclined surface 28*a* to move back and forth so as to move toward and away from the other end surface 12*h* of the cylinder block 12. Thus, it is possible to change the dead center position (more specifically, the axial position of the dead center) of the spool 26 in the cylinder bore 12*a*. For example, when the swash plate rotating shaft-end inclined surface 28*a* moves forward in the one axial direction, the dead center position of the spool 26 in the cylinder bore 12*a* shifts in the one axial direction. On the other hand, when the swash plate rotating shaft-end inclined surface 28*a* moves backward in the other axial direction, the dead center position of the spool 26 in the cylinder bore 12*a* shifts in the other axial direction. Therefore, the opening/closing position of the spool 26 in the cylinder bore 12*a* can be shifted in the axial direction.

The effective stroke length S of the piston 21 is a range of stroke in which the working fluid can be discharged from the cylinder bore 12*a*. Therefore, by shifting the opening/closing position of the spool 26 in the axial direction, it is possible to change the effective stroke length S of the piston 21. Thus, it is possible to change the discharge capacity of the cylinder bore 12*a* by moving the swash plate rotating shaft-end inclined surface 28*a* back and forth in the axial direction.

<Inlet Check Valve>

Figure 4:
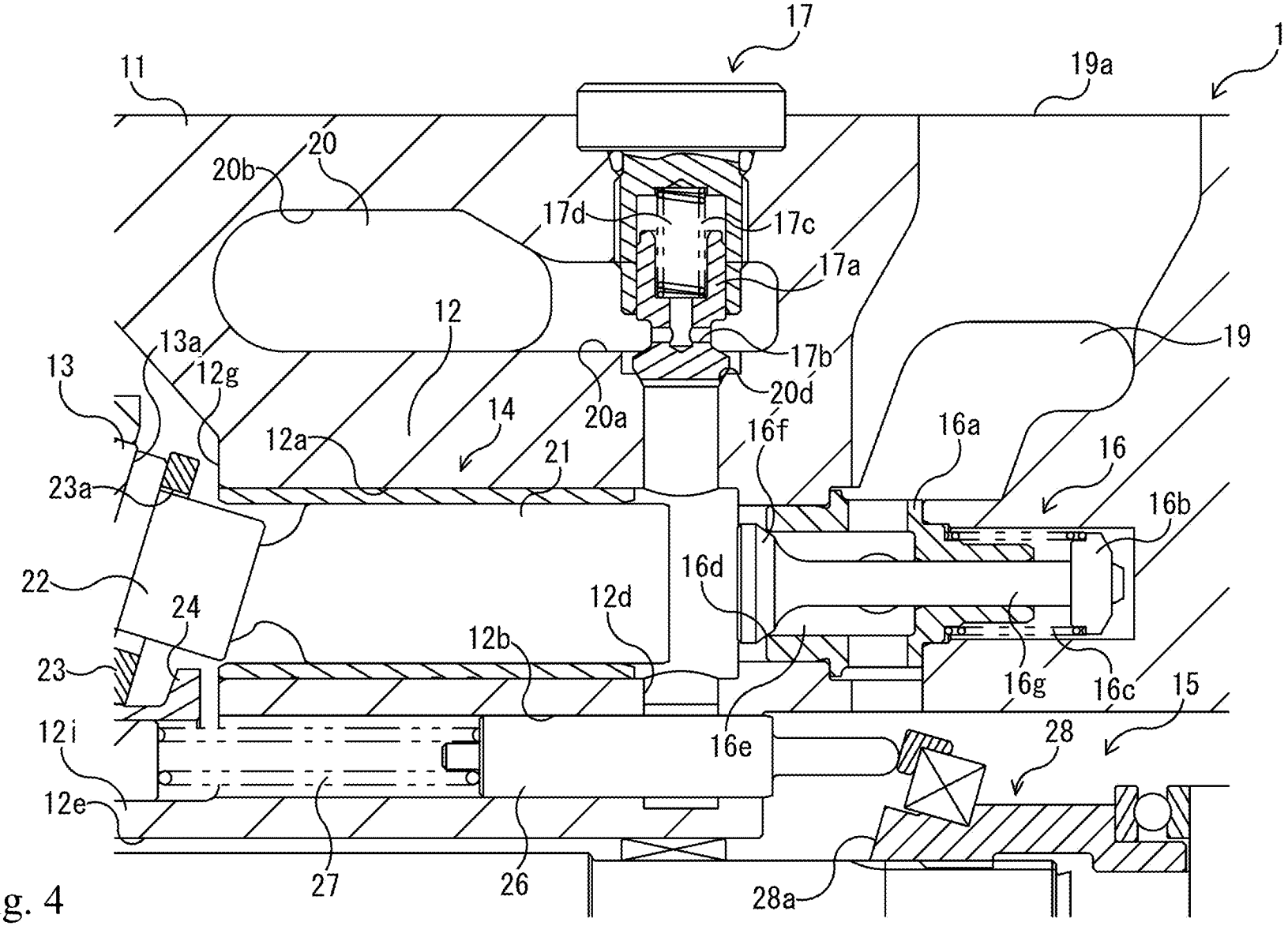
FIG. 4 is an enlarged cross-sectional view of a region X illustrated in FIG. 1.

Each of the inlet check valves 16 allows the flow of the working fluid in one direction from the inlet passage 19 to the corresponding cylinder bore 12*a* and blocks the opposite flow of the working fluid. The inlet check valves 16 are provided on the cylinder bores 12*a*. In the present embodiment, there are the same number of inlet check valves 16 as the cylinder bores 12*a*, specifically, nine inlet check valves 16. The inlet check valves 16 are inserted into the other axial ends of the cylinder bores 12*a*. In the present embodiment, the inlet check valve 16 has one end portion thereof inserted into the inlet-end opening 12*j*, as illustrated in FIG. 4. The other end portion of the inlet check valve 16 protrudes from the cylinder bore 12*a* to the inlet passage 19. The inlet check valve 16 is disposed so as to face an end of the piston 21 that is located on the other side in the axial direction. The inlet check valve 16 is formed having a diameter less than the diameter of the cylinder bore 12*a* as viewed in the axial direction. The inlet check valve 16 is disposed on the cylinder bore 12*a* so that axes thereof match each other.

More specifically, each of the inlet check valves 16 includes a sleeve 16*a*, a valve body 16*b*, and a spring 16*c*. The sleeve 16 is formed in the shape of a circular cylinder. One end portion of the sleeve 16*a* is inserted into the cylinder bore 12*a*, and one end of the sleeve 16*a* constitutes a valve seat 16*d*. An inner passage 16*e* is formed in the sleeve 16*a*. The inner passage 16*e* connects the inlet passage 19 and the cylinder bore 12*a*.

The valve body 16*b* includes an umbrella portion 16*f* and a valve shaft portion 16*g*. The valve body 16*b* is a poppet valve body. The valve body 16*b* is seated on the valve seat 16*d* and moves away from the valve seat 16*d* toward the piston 21. Thus, the valve body 16*b* opens and closes the path between the inlet passage 19 and the cylinder bore 12*a*. The valve body 16*b* protrudes from the inlet-end opening 12*j* in the other axial direction.

In the valve body 16*b*, the umbrella portion 16*f* is formed on the side of the cylinder bore 12*a*. The umbrella portion 16*f* is seated on the valve seat 16*d*. The umbrella portion 16*f* moves away from the valve seat 16*d* toward the piston 21. The valve shaft portion 16*g* is inserted through the sleeve 16*a* and extends from the umbrella portion 16*f* in the other axial direction.

The spring 16*c* biases the valve body 16*b* so that the valve body 16*b* is seated on the valve seat 16*d*. More specifically, the spring 16*c* biases the valve body 16*b* against the pressure of the working fluid that is introduced from the inlet passage 19 to the inlet check valve 16 (more specifically, the sleeve 16*a*). Therefore, the inlet check valve 16 opens the path between the cylinder bore 12*a* and the inlet passage 19 in the intake process in which the piston 21 moves from the top dead center to the bottom dead center, and closes the path between the cylinder bore 12*a* and the inlet passage 19 in the discharge process. The spring 16*c* is disposed on the upstream side of the valve seat 16*d*. More specifically, the spring 16*c* is disposed on a portion of the valve body 16*b* that is located on the other side in the axial direction (a portion protruding from the inlet-end opening 12*j*).

<Discharge Check Valve>

Each of the discharge check valves 17 illustrated in FIG. 1 allows the flow of the working fluid in one direction from the corresponding cylinder bore 12*a* to the discharge port 20*c* and blocks the opposite flow of the working fluid. Each of the discharge check valves 17 is provided on a corresponding one of the cylinder bores 12*a*. This means that there are the same number of discharge check valves 17 as the cylinder bores 12*a*, specifically, nine discharge check valves 17, in the present embodiment. The discharge check valves 17 are positioned radially outward of the inlet check valves 16 as viewed in the axial direction. More specifically, the radially outermost portion of a valve body 17*a* of the discharge check valve 17 is located outside of the radially outermost portion of the valve body 16*b* of the inlet check valve 16. Here, a valve seat 20*d* of the discharge check valve 17 is located outside of the shaft center of the inlet check valve 16. The discharge check valve 17 extends radially outward. The discharge check valve 17 is provided on the branch portion 20*a* of the discharge passage 20. In the present embodiment, the discharge check valve 17 is inserted from the outer peripheral surface of the casing 11 into a radially extending portion of the branch portion 20*a*. Thus, the discharge check valve 17 can open and close the discharge passage 20 at a position away from the ring-shaped portion 20*b*. This leads to less impact from the working fluid that is brought from another cylinder bore 12*a* to the ring-shaped portion 20*b* regarding the opening/closing operation of the discharge check valve 17.

More specifically, the discharge check valve 17 includes the valve body 17*a*, as illustrated in FIG. 4. The valve body 17*a* is seated on the valve seat 20*d* located on the branch portion 20*a*. The valve body 17*a* is biased by a spring 17*c* toward the cylinder bore 12*a*. The spring 17*c* herein is disposed on the downstream side of the valve seat 20*d*. The valve body 17*a* includes an inner passage 17*b*. The valve body 17*a* brings the downstream pressure of the valve body 17*a* to a back pressure chamber 17*d* through the inner passage 17*b*. Thus, the upstream-downstream pressure of the valve body 17*a* acts on the valve body 17*a*. Therefore, the valve body 17*a* moves away from the valve seat 20*d* in the discharge process. As a result, the discharge passage 20 (more specially, the branch portion 20*a*) is opened. This allows the flow of the working fluid in one direction from the cylinder bore 12*a* to the discharge port 20*c*. In other words, the working fluid flows from the cylinder bore 12*a* to the discharge port 20*c* in the discharge process. On the other hand, the discharge check valve 17 blocks the opposite flow of the working fluid. Therefore, in the intake process, the flow of the working fluid from the cylinder bore 12*a* to the discharge port 20*c* is stopped.

<Operation of Pump>

Next, the operation of the pump 1 will be described. When the drive source rotatably drives the rotary swash plate 13, each of the pistons 21 reciprocates within the corresponding cylinder bore 12*a* accordingly. Thus, the piston 21 draws the working fluid from the inlet passage 19 into the cylinder bore 12*a* via the inlet check valve 16 in the intake process. On the other hand, the piston 21 discharges the working fluid from the cylinder bore 12*a* via the discharge check valve 17 and the discharge passage 20 in the discharge process. More specifically, when the working fluid in the cylinder bore 12*a* is pressurized by the piston 21 in the discharge process, the discharge check valve 17 eventually opens the discharge passage 20. Thus, the working fluid is brought from the cylinder bore 12*a* to the ring-shaped portion 20*b* via the branch portion 20*a*. Subsequently, the working fluid is discharged from the discharge port 20*c*.

Furthermore, in the pump 1, when the swash plate rotating shaft 28 rotates in conjunction with the rotation of the rotary swash plate 13, each of the spools 26 reciprocates within the corresponding spool hole 12*b* in synchronization with the corresponding piston 21. As a result, the communication passage 12*d* is opened midway through the intake process of the piston 21, and the communication passage 12*d* is closed midway through the discharge process of the piston 21. Thus, the cylinder bore 12*a* and the communication passage 12*d* are in communication until the communication passage 12*d* is closed (in other words, until the piston 21 travels the open stroke length S2) in the discharge process. The discharge of the working fluid from the cylinder bore 12*a* to the discharge port 20*c* is limited until the communication passage 12*d* is closed. Therefore, the effective stroke length S of each of the pistons 21 is less than the actual stroke length S1 by the open stroke length S2, and the pump 1 discharges an amount of the working fluid that corresponds to the effective stroke length S. In the pump 1, the linear motion actuator 18 moves the swash plate rotating shaft-end inclined surface 28*a* in the axial direction, and thus the opening/closing position of each of the spools 26 is changed. As a result, the effective stroke length S of each of the pistons 21 can be changed, meaning that the discharge capacity of the pump 1 is increased or decreased.

In the pump 1 according to the present embodiment, the variable capacity mechanism 15 includes the spool 26 that changes the effective stroke length S of the piston 21. Therefore, the discharge capacity of the pump 1 can be changed. The cylinder block 12 includes the spool hole 12*b* into which the spool 26 is inserted in such a manner that the spool 26 can reciprocate therein. Therefore, as compared to the case where the spool hole 12*b* is positioned in the casing 11 outside the cylinder block 12, the spool hole 12*b* can be compactly placed, meaning that the pump 1 can be made compact. Thus, the pump 1 with a variable discharge capacity can be made compact.

Furthermore, in the pump 1 according to the present embodiment, the spool hole 12*b* is positioned inward of the cylinder bore 12*a*. Therefore, the pump 1 can be made more compact.

Furthermore, in the pump 1 according to the present embodiment, the housing hole 12*c* is disposed between the spool hole 12*b* and the cylinder bore 12*a* in the radial direction. This eliminates the need to secure separate space for forming the housing hole 12*c* in the cylinder block 12, meaning that the pump 1 can be made more compact.

Furthermore, in the pump 1 according to the present embodiment, the inlet check valve 16 is inserted into the other axial end portion of the cylinder bore 12*a*. As a result, the inlet check valve 16 connects the cylinder bore 12*a* and the inlet passage 19, and thus a cylinder port connecting the cylinder bore 12*a* and the inlet passage 19 can be eliminated. Therefore, the pump 1 can be made more compact.

Furthermore, in the pump 1 according to the present embodiment, the inlet check valve 16 is disposed so as to face the end of the piston 21 that is located on the other side in the axial direction. Therefore, the space in the pump 1 can be effectively used.

Furthermore, in the pump 1 according to the present embodiment, the discharge check valve 17 is positioned radially outward of the inlet check valve 16 as viewed in the axial direction. In this case, the discharge check valve 17 and the inlet check valve 16 can be positioned close to each other in the axial direction. Therefore, the pump 1 can be made axially compact.

Furthermore, in the pump 1 according to the present embodiment, the discharge check valve 17 extends radially outward. Therefore, the pump 1 can be made axially compact.

Furthermore, in the pump 1 according to the present embodiment, the valve body 16*b* of the inlet check valve 16 protrudes from the inlet passage 19 in the other axial direction, and the spring 16*c* is disposed on a portion of the valve body 16*b* that is located on the other side in the axial direction. Therefore, an element of the inlet check valve 16 can be disposed outside the cylinder bore 12*a*. This can keep the cylinder bore 12*a* from increasing in length, meaning that the pump 1 can be made axially compact.

Furthermore, in the pump 1 according to the present embodiment, the inlet check valve 16 is inserted into the other axial end portion of the cylinder bore 12*a*. As a result, the inlet check valve 16 connects the cylinder bore 12*a* and the inlet passage 19, and thus a cylinder port can be eliminated. Furthermore, the discharge check valve 17 is positioned radially outward of the inlet check valve 16 as viewed in the axial direction, and the discharge check valve 17 extends radially outward. Therefore, the pump 1 can be made more compact.

OTHER EMBODIMENTS

In the pump 1 according to the present embodiment, the plurality of spool holes 12*b* may be positioned outward of the plurality of cylinder bores 12*a*. Each of the spool holes 12*b* may be positioned circumferentially offset from a position radially inward of the corresponding cylinder bore 12*a*. The pump 1 according to the present embodiment does not necessarily need to include the plurality of shoes 22, the pressing plate 23, the spherical bushing 24, and the plurality of biasing members 25; in the pump 1 according to the present embodiment, the piston 21 may be in direct abutment with the rotary swash plate 13. The inlet check valve 16 does not necessarily need to be inserted into the inlet-end opening 12*j* of the cylinder bore 12*a* and may be added to a cylinder port or the like additionally formed. Furthermore, the shape of the discharge passage 20 is not limited to the shape mentioned above. For example, the branch portions 20*a* may extend radially inward from the ring-shaped portion 20*b* and be connected to the cylinder bores 12*a*. In this case, the discharge check valves 17 are disposed on the branch portions 20*a* so as to penetrate the ring-shaped portion 20*b*.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

REFERENCE CHARACTER LIST

1 rotary swash plate hydraulic pump
11 casing
12 cylinder block

12*a* cylinder bore
12*b* spool hole
12*c* housing hole
13 rotary swash plate
14 piston mechanism
15 variable capacity mechanism
16 inlet check valve
16*b* valve body
16*c* spring
16*d* valve seat
17 discharge check valve
17*c* spring
19 inlet passage
21 piston
22 shoe
23 pressing plate
25 biasing member
26 spool
27 spring
30 tank

The invention claimed is:

1. A rotary swash plate hydraulic pump comprising:
a casing;
a cylinder block including a cylinder bore and disposed in the casing so as to prevent relative rotation of the cylinder block;
a piston that is inserted into the cylinder bore;
a rotary swash plate that is housed in the casing so as to be rotatable about an axis and reciprocates the piston; and
a variable capacity mechanism that changes an effective stroke length of the piston, wherein:
the variable capacity mechanism includes a spool that changes the effective stroke length of the piston by adjusting opening and closing of the cylinder bore that corresponds to the spool; and
the cylinder block includes a spool hole into which the spool is inserted.

2. The rotary swash plate hydraulic pump according to claim 1, wherein:
the spool hole is positioned inward of the cylinder bore.

3. The rotary swash plate hydraulic pump according to claim 1, further comprising:
a shoe that is rotatably coupled to the piston and slidably abuts the rotary swash plate;
a pressing plate that is attached to the shoe; and
a biasing member that biases the pressing plate toward the rotary swash plate to press the shoe against the rotary swash plate, wherein:
the cylinder block includes a housing hole in which the biasing member is housed; and
the housing hole is disposed between the cylinder bore and the spool hole in a radial direction.

4. The rotary swash plate hydraulic pump according to claim 1, further comprising:
an inlet check valve that allows a flow of a working fluid in one direction to the cylinder bore and blocks an opposite flow of the working fluid, wherein:
the casing includes an inlet passage in which the working fluid flows;
the piston is inserted into an end of the cylinder bore that is located on one side in an axial direction;
the cylinder bore is connected to the inlet passage on the other side in the axial direction; and
the inlet check valve is inserted into a portion of the cylinder bore that is located on the other side in the axial direction.

5. The rotary swash plate hydraulic pump according to claim 4, wherein:
the cylinder bore extends in the axial direction; and
the inlet check valve is disposed so as to face an end of the piston that is located on the other side in the axial direction.

6. The rotary swash plate hydraulic pump according to claim 4, further comprising:
a discharge check valve that allows a flow of the working fluid in one direction discharged from the cylinder bore and blocks an opposite flow of the working fluid, wherein:
the discharge check valve is positioned radially outward of the inlet check valve as viewed in the axial direction.

7. The rotary swash plate hydraulic pump according to claim 6, wherein:
the discharge check valve extends in the radial direction.

8. The rotary swash plate hydraulic pump according to claim 4, wherein:
the inlet check valve includes: a valve body that is seated on a valve seat located in the cylinder bore; and a spring that biases the valve body to cause the valve body to be seated on the valve seat;
the valve body protrudes from the cylinder bore to the inlet passage; and
the spring is disposed on a portion of the valve body that is located on the other side in the axial direction.

9. A rotary swash plate hydraulic pump comprising:
a casing;
a cylinder block including a cylinder bore and disposed in the casing so as to prevent relative rotation of the cylinder block;
a piston that is inserted into the cylinder bore;
a rotary swash plate that is housed in the casing so as to be rotatable about an axis and reciprocates the piston;
a variable capacity mechanism that changes an effective stroke length of the piston;
an inlet check valve that allows a flow of a working fluid in one direction to the cylinder bore and blocks an opposite flow of the working fluid; and
a discharge check valve that allows a flow of the working fluid in one direction discharged from the cylinder bore and blocks an opposite flow of the working fluid, wherein:
the piston is inserted into an end of the cylinder bore that is located on one side in an axial direction;
the cylinder bore is connected to an inlet passage on the other side in the axial direction;
the inlet check valve is inserted into a portion of the cylinder bore that is located on the other side in the axial direction; and
the discharge check valve is positioned radially outward of the inlet check valve as viewed in the axial direction.

* * * * *